US006911785B2

(12) United States Patent
Yu et al.

(10) Patent No.: US 6,911,785 B2
(45) Date of Patent: Jun. 28, 2005

(54) PLASMA DISPLAY PANEL WITH GRAY LEVEL WHITE BALANCE DEVICE

(75) Inventors: Yi-Sheng Yu, Taoyuan (TW); Hsu-Pin Kao, Ping Chen (TW); Yi-Chia Shan, Chung Li (TW); Hui-Chen Lin, Pa Te (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 53 days.

(21) Appl. No.: 10/665,435

(22) Filed: Sep. 22, 2003

(65) Prior Publication Data

US 2004/0155837 A1 Aug. 12, 2004

(30) Foreign Application Priority Data

Jan. 29, 2003 (TW) ..... 92102056 A

(51) Int. Cl.[7] ..... G09G 3/10
(52) U.S. Cl. ..... 315/169.4; 345/690; 345/63
(58) Field of Search ..... 315/169.1, 169.4; 345/204, 690, 60, 63

(56) References Cited

U.S. PATENT DOCUMENTS

| | | | | | |
|---|---|---|---|---|---|
| 5,856,823 | A | * | 1/1999 | Kimoto et al. | 345/600 |
| 5,943,032 | A | * | 8/1999 | Nagaoka et al. | 345/63 |
| 6,473,061 | B1 | * | 10/2002 | Lim et al. | 345/60 |
| 6,693,609 | B2 | * | 2/2004 | Lee et al. | 345/63 |
| 2002/0180718 | A1 | * | 12/2002 | La | 345/204 |
| 2003/0151565 | A1 | * | 8/2003 | Kim et al. | 345/60 |

* cited by examiner

*Primary Examiner*—Thuy Vinh Tran
(74) *Attorney, Agent, or Firm*—Sughrue Mion, PLLC

(57) ABSTRACT

A plasma display panel with a gray level white balance device is described. The plasma display panel with a gray level white balance device has a digital board, a display control circuit and a color plasma display panel. The digital board utilizes the gray level white balance device to modify gray levels of the image to fit the gray levels of the color plasma display panel according to a gray level lookup table. The gray level lookup table is established by measuring the color temperature and color deviation of the color plasma display panel at different gray levels. Curve fitting or linear regression techniques further utilize to enhance the resolution of the gray level lookup table.

20 Claims, 4 Drawing Sheets

PLASMA DISPLAY PANEL WITH GRAY LEVEL WHITE BALANCE DEVICE

FIELD OF THE INVENTION

The present invention relates to a gray level white balance method for a plasma display panel and especially to a plasma display panel with a gray level white balance device.

BACKGROUND OF THE INVENTION

Conventional cathode ray tube (CRT) displays are unsuitable for use in multimedia applications because of their large volume. Therefore, many flat panel display techniques such as liquid crystal display (LCD), plasma display panel (PDP), and field emission display (FED) have been recently developed. These display techniques can manufacture a thin, light, short and small monitor, and thus these techniques are and will be the mainstream technology. In these techniques, the plasma display panel (PDP) is attracting attention in the field of displays as a full-color display apparatus having a large size display area and is especially popularly utilized in large-size televisions or outdoor display panels. This is because it is a high quality display as a result of it being a self-light emitting type with a wide angle of visibility and high speed of response as well as being suited to upsizing due to a simple manufacturing process.

A color PDP is a display in which ultraviolet rays are produced by gas discharge to excite phosphorus so that visible light is emitted therefrom to perform a display operation. Depending upon a discharge mode, the color PDP is classified as an alternating current (AC) or a direct current (DC) type. In the AC-type PDP, an electrode is covered with a protective layer. The AC-type PDP has inherent characteristics of long life and high brightness. Therefore, the AC-type PDP is generally superior to the DC-type PDP in luminance, luminous efficiency and lifetime.

PDP utilizes an external voltage to cause gas discharge inside the panel to produce the ultraviolet rays. The ultraviolet rays excite R, G, and B phosphorus to generate the visible R, G, and B lights. Therefore, the reddish orange color light caused by the gas discharge and the chromaticity purity of R, G, and B phosphorus apparently influences the output color of the PDP module. A good white balance of the PDP module is very important to produce a good color display so the balance of fundamental colors emitted by the R, G, and B phosphorus is important. However, even if a surface filter of the PDP module can filter the reddish orange color and modify the chromaticity of the PDP output, the color space of the PDP module still is different from the color space of the video specification, such as National Television System Committee (NTSC), European Broadcasting Union (EBU) or Standard RGB (sRGB). If there is not sufficient color space transformation, the output color of the PDP module may display visible color deviation. For example, the sky may be too green and a white cloud may be too yellow in a conventional PDP module. In particular, if the image quality is very bad, skin color may become too red or too green when the video specification of the PDP module and the video image signals are different.

The color deviation problem caused by the actual luminous efficiencies of the three fundamental colors of the PDP does not fit the correct luminance ratio requirement; that is, a gray level white balance error exists. Some conventional plasma display panels utilize a nonsymmetrical pixel technology to improve the white balance problem so that the discharge cells are formed in different sizes and the address electrodes are also formed in different widths. Therefore, the manufacture process difficulties and the cost are increased and furthermore the nonlinear luminous efficiency decay of the PDP still exists. Another conventional plasma display panel adjusts the driving frequency to improve the white balance problem by diagnosing the display load factor. Therefore, the electric circuit thereof is more complicates and expensive due to more complicated determination of electric circuits with determining theories. Therefore, there is a need to provide a plasma display panel which can achieve a satisfying gray level white balance thereof so as to reduce the color deviation thereof.

SUMMARY OF THE INVENTION

One object of the present invention is to provide a plasma display panel with a gray level white balance device to reduce the color deviation problem and easily adjust the gray level white balance so as to display a satisfactory image and color.

Another object of the present invention is to provide a gray level white balance method for the plasma display panel effectively to correct the gray level white balance of the output image of the plasma display panel.

The present invention provides a plasma display panel with a gray level white balance device. The plasma display panel comprises a digital board, a display control circuit, and a color plasma display panel. The digital board comprises a gray level white balance device and receives image display signals to process the same. The gray level white balance device modifies the image display signals into modified image display signals with suitable gray levels according to a look up table. The display control circuit receives the modified image display signals and generates control signals. The color plasma display panel receives the control signals and the modified image display signals, and displays the modified image display signals thereon according to the control signals.

The digital board further comprises a microprocessor unit and an image processor. The microprocessor unit receives a user selection signal and issues a request to change the gray levels of the image display signals according to the user selection signal. The image processor receives and processes the request and the image display signals and transfers the request and the image display signals to the gray level white balance device. The digital board further comprises a de-contouring processing device to process the modified image display signals with an error diffusion method to enhance the resolution of the modified image display signals.

The display control circuit further comprises a scan sustainer, a scan driver integrated circuit, and a bulk sustainer to control the color plasma display panel, and further comprises a data driver integrated circuit to receive the modified image display signals and transmit the same to the color plasma display panel. The digital board further comprises a timing controller to provide timing signals for the digital board and the display control circuit.

The look up table is measured directly on the plasma display panel with color temperatures and color deviations by a color analyzer to obtain the look up table with RGB gray level comparison. The look up table further enhances resolutions thereof with a curve fitting technology or a linear regression technology.

Another aspect of the present invention is to provide a gray level white balance method. The method comprises the following procedures. Fundamental color gray levels of a plasma display panel are measured. A gray level white balance look up table is obtain with calculating data of the fundamental color gray levels of a plasma display panel. While image display signals are provided, the image display signals are modified according to the gray level white balance look up table. Then, the modified image display signals are displayed on the plasma display panel.

The method further utilizes an error diffusion method to enhance resolutions of the modified image display signals. The step of measuring fundamental color gray levels of a plasma display panel further comprises the following procedures. A base color of fundamental colors is determined and a gray level of the base color of the fundamental colors is chosen. Gray levels of other colors of the fundamental colors are adjusted. Then, a color temperature and a color deviation are measured on the plasma display panel. When the color temperature and the color deviation do not fit respective object values, the method returns to the step of adjusting gray levels of other colors of the fundamental colors. When the color temperature and the color deviation fit the respective object value, the gray level of the base color and the gray levels of other colors are recorded. The method repeatedly returns to the foregoing step to adjust gray levels of the fundamental colors and then measures the color temperature and the color deviation until the gray level white balance of the look up table is obtained.

The gray level white balance look up table further utilizes a curve fitting technology or a linear regression technology to enhance resolutions thereof.

Hence, the plasma display panel with a gray level white balance device and the gray level white balance method according to the present invention effectively adjust image output gray levels of the plasma display panel to demonstrate high quality video image and effectively to reduce the color deviation problem.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

The following description is the best presently contemplated mode of carrying out the present invention. This description is not to be taken in a limiting sense but is made merely for the purpose of describing the general principles of the invention. The scope of the invention should be determined by referencing the appended claims.

Figure 1:
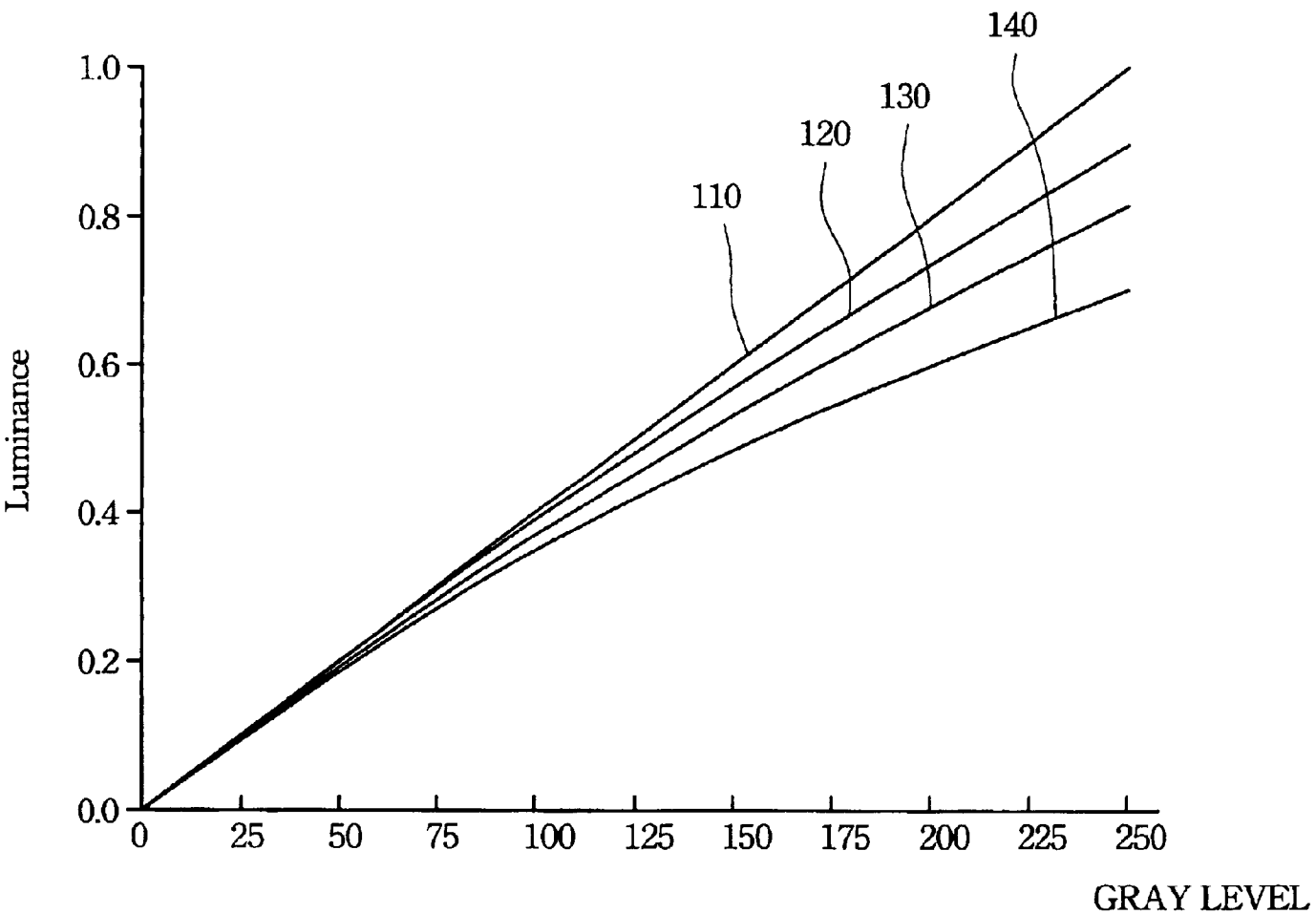
FIG. 1 illustrates a relationship of gray level vs. luminance.

FIG. 1 illustrates a relationship of gray level (0~255) vs. luminance (0~1, normalized). In FIG. 1, a linear line 110 represents a linear relationship of gray level vs. luminance. Line 120 represents the relationship of gray level vs. luminance of blue light emitting elements of the plasma display panel. Line 130 represents the relationship of gray level vs. luminance of red light emitting elements of the plasma display panel. Line 140 represents the relationship of gray level vs. luminance of green light emitting elements of the plasma display panel. Line 120 is the one closest to the linear line 110, line 130 is second and line 140 is third; that is, the blue light emitting elements of the plasma display panel provide an approximate linear light emitting efficiency. Namely, the blue light emitting element has a smaller luminous efficiency decay for the gray level increase to maintain an approximately linear directly proportion relationship to the gray level and luminance.

Therefore, if the plasma display panel wishes to display a proper color image, the three fundamental colors mixture ratio has to correct and the nonlinear luminous efficiency decay due to the gray level increase in particular must be eliminated. The gray level white balance method according to the present invention utilizes a practical measurement on the PDP module output and results in a look up table to correct the gray level white balance. Therefore, the plasma display panel according to the present invention can instantly correct the gray level white balance so that the plasma display panel can maintain an output image with an optimum gray level white balance to reduce color deviation and display colors of the video image close to the actual original color.

Figure 2:
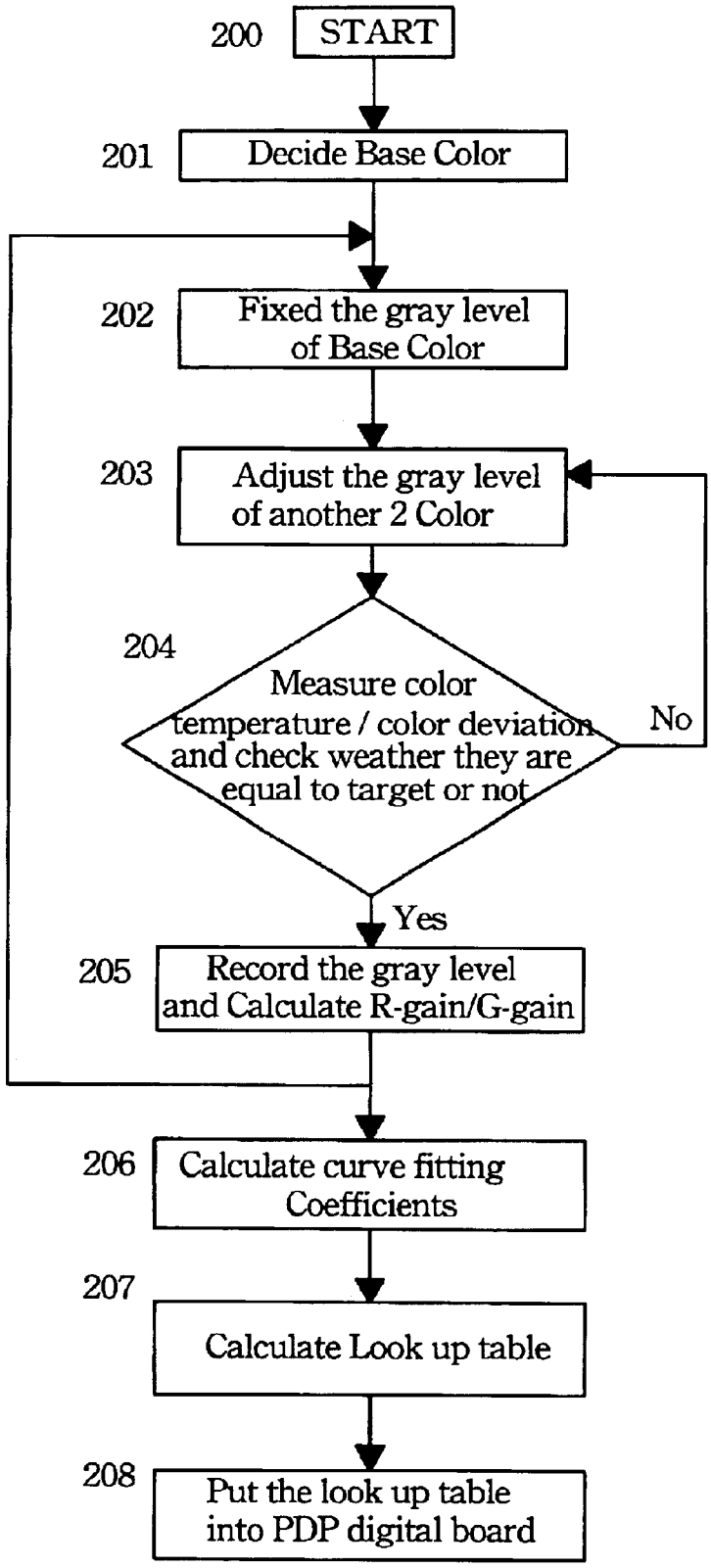
FIG. 2 is a flow chart for establishing a look up table for the PDP module with a gray level white balance device according to the present invention.

FIG. 2 is a flow chart for establishing a look up table for the PDP module with a gray level white balance device according to the present invention. The following description illustrates in detail how the look up table can be established as an example, only, and should not be construed as a limitation on the scope of the present invention. The method starts from step 200 and then proceeds to step 201. Step 201 determines a base color; normally, the base color is as close to the linear relationship of luminance vs. gray level as possible to calculate easily gains for other colors. Therefore, blue is a preferred base color for the gray level white balance method according to the present invention. The present invention is not limited to use of blue as the base color, and red, green or any other predetermined color mixture can be set as the base color for the present invention.

Step 202 determines a gray level of the base color and step 203 determines gray levels for another two colors. Step 204 measures the color temperature and the color deviation and determines whether the values of the color temperature and the color deviation are equal to the target value or not; for example the target color temperature is 9300 K and the target color deviation is close to zero. If the color temperature and the color deviation fit the target requirement, step 205 records the RGB gray level values and calculates R-gain and B-gain. If the color temperature or the color deviation cannot fulfill the target requirement, the method goes back step 203 to adjust the gray level values of green color and red color until both the color temperature and the color deviation fit the target requirements. Table 1 is a record form to record RGB gray levels under a predetermined acceptable color deviation. An exemplary record procedure is to set the blue color as a base color and determine a gray level value, B-fixed, and then repeatedly choose a red gray level value and a green gray level value to measure the color deviation and the color temperature until the color deviation and the color temperature is within predetermined acceptable requirements. Then, the red gray level value and the green gray level value are recorded in the G-adjust and R-adjust columns.

TABLE 1

| Record Form of RGB Gray Level | | | | |
|---|---|---|---|---|
| R-adjust | G-adjust | B-fixed | R-gain | G-gain |
| $R_1$ | $G_1$ | $B_1$ | $Rg_1$ | $Gg_1$ |
| $R_2$ | $G_2$ | $B_2$ | $Rg_2$ | $Gg_2$ |
| $R_3$ | $G_3$ | $B_3$ | $Rg_3$ | $Gg_3$ |
| . | . | . | . | . |
| . | . | . | . | . |
| . | . | . | . | . |
| $R_{n-1}$ | $G_{n-1}$ | $B_{n-1}$ | $Rg_{n-1}$ | $Gg_{n-1}$ |
| $R_n$ | $G_n$ | $B_n$ | $Rg_n$ | $Gg_n$ |

Normally, the color deviation and the color temperature are measured by a color analyzer. While the color deviation and the color temperature are within the respective predetermined acceptable requirements, one set of the B-fixed value, the G-adjust value, and the R-adjust value are recorded.

After step 205, the procedure goes back step 202 to measure another set of B-fixed value, R-adjust, and G-adjust until a predetermined quantity data of the RGB gray level are obtained. The gray level white balance method according to the present invention further utilizes a curve fitting technology to fit the data. Therefore, step 206 calculates the coefficients for the curve fitting method. The curve fitting method can efficiently reduce the quantity of measuring data so as to establish efficiently the look up table. Step 207 uses the calculated curve fitting coefficients to set up the look up table. Step 208 writes data of the look up table into the digital circuit of a plasma display panel.

The following description detailed explains the feature and spirit of the present invention with detailed embodiment and exemplary data thereof. The exemplary data and explanation are given to illustrate the characteristic and spirit of the present rather than to limit the present invention.

Table 2 records the measured and calculated data of the gray level, R-gain, and G-gain generated by step 200 to step 205 in FIG. 2.

TABLE 2

| Data of RGB Gray Level and Corresponding R-gain and G-gain | | | | |
|---|---|---|---|---|
| R-adjust | G-adjust | B-fixed | R-gain | G-gain |
| 225 | 198 | 250 | 0.900 | 0.792 |
| 203 | 178 | 225 | 0.902 | 0.791 |
| 180 | 156 | 200 | 0.900 | 0.780 |
| 151 | 128 | 175 | 0.863 | 0.731 |
| 130 | 109 | 150 | 0.867 | 0.727 |
| 108 | 88 | 125 | 0.864 | 0.704 |
| 84 | 67 | 100 | 0.840 | 0.670 |
| 63 | 49 | 75 | 0.840 | 0.653 |
| 41 | 30 | 50 | 0.820 | 0.600 |
| 20 | 15 | 25 | 0.800 | 0.600 |

The R-gain means R-adjust/B-fixed, for example 225/250=0.9, and the G-gain means G-adjust/B-fixed, for example 198/250=0.792.

Subsequently, at least one second order equation is utilized to fit the measured data. Equation 1 and equation 2 are exemplary equations and are illustrated as follows:

$$R\text{-gain}=Ar\cdot(B\text{-fixed})^2+Br\cdot(B\text{-fixed})+Cr \quad \text{(eq. 1)}$$

$$G\text{-gain}=Ag\cdot(B\text{-fixed})^2+Bg\cdot(B\text{-fixed})+Cg \quad \text{(eq. 2)}$$

Equation 1 and equation 2 are both second order equations with unknown coefficients, Ar, Br, Cr, Ag, Bg, and Cg. The unknown coefficients can be found by the curve fitting technology. Moreover, a linear regression method or any other similar analysis method can also help for solving the unknown coefficients.

Figure 3:
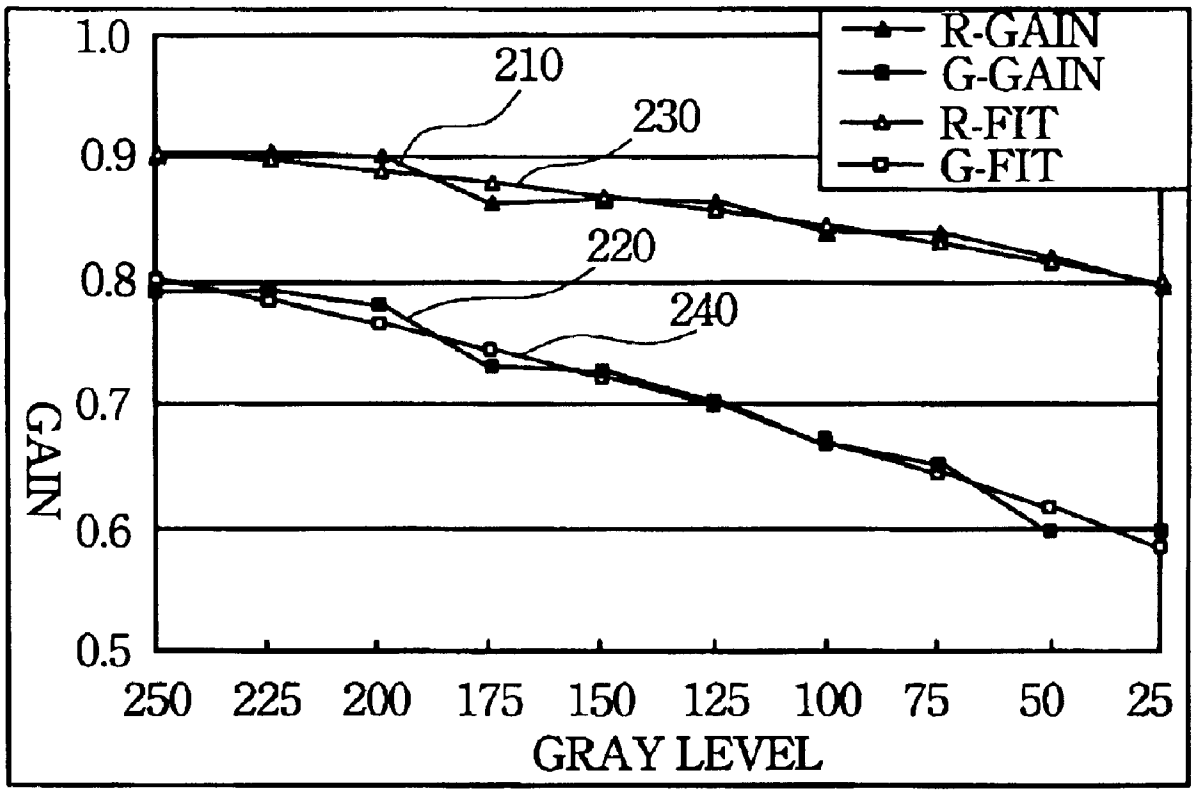
FIG. 3 illustrates a relationship of gray level vs. R-gain and G-gain of approximate values with curve fitting method.

FIG. 3 illustrates a relationship of gray level vs. R-gain and G-gain of approximate values with a curve fitting method. Curve 210 couples the measured data of R-gain and Curve 230 couples the approximate values of R-gain generated by the second order curve fitting method. With the same scheme, curve 220 couples the measured data of G-gain and curve 240 couples the approximate values of G-gain generated by the second order curve fitting method. The present invention is not limited to the second order curve fitting equation. A high order polynomial equation, a power series, a logarithmic function, an exponential function or any other similar equation can be utilized to fit the measured data with the curve fitting method.

The method therefore calculates each corresponding green gray level value and red level with the equation 1 and equation 2 with the found curve fitting coefficients. Table 3 is a comparison table for RGB gray level value, that is, a look up table.

TABLE 3

| RGB Gray Level Comparison Table | | | | | | | | | | | | | | |
|---|---|---|---|---|---|---|---|---|---|---|---|---|---|---|
| B | 0 | 1 | 2 | 3 | 4 | 5 | . | . | . | 250 | 251 | 252 | 253 | 254 | 255 |
| R | 0 | 0.8 | 1.6 | 2.4 | 3.2 | 4.0 | . | . | . | 226.0 | 227.0 | 228.0 | 228.9 | 229.9 | 230.9 |
| G | 0 | 0.6 | 1.1 | 1.7 | 2.2 | 2.8 | . | . | . | 200.3 | 201.2 | 202.2 | 203.1 | 204.1 | 205.1 |

The look up table is burned into a digital board of the plasma display panel for the plasma display panel to display an accurate image color output. With the look up table, the plasma display panel can effectively obtain the correct RGB gray level to display an image with a correct color temperature within the predetermined color deviation.

The present invention further magnifies the gray level value in Table 3 due to the decimal fraction. The decimal fraction is unfavorable for processing in the digital circuit, and therefore the present invention suitably enlarges the value thereof, such as multiplying by $2^7$=128, and then bums the data into the digital board. The enlarged data can also enhance precision of a next step for de-contouring process.

Figure 4:
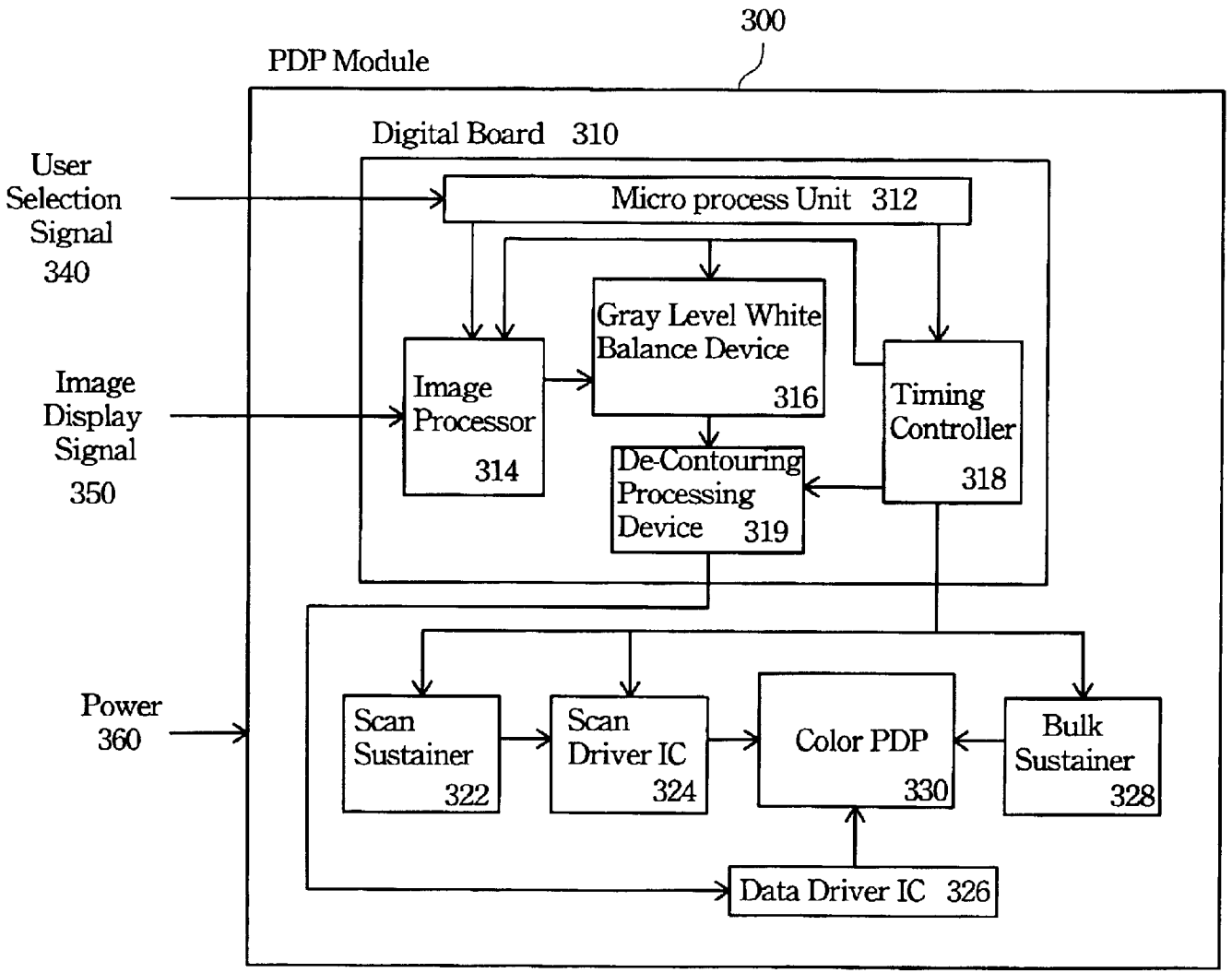
FIG. 4 is a block diagram of the PDP module with a gray level white balance device according to the present invention.

FIG. 4 is a block diagram of the PDP module with a gray level white balance device according to the present invention. The plasma display panel module 300 with a gray level white balance device according to the present invention includes a digital board 310, a scan sustainer 322, a scan driver IC 324, a color plasma display panel 330, a bulk sustainer 328, and a data driver IC 326. The digital board 310 further includes a microprocessor unit 312, an image processor 314, a gray level white balance device 316, a de-contouring processing device 319, and a timing controller 318. Further, the scan sustainer 322, the scan driver IC 324, the color plasma display panel 330, the bulk sustainer 328, and the data driver IC 326 constitute the image displaying device and the control circuit thereof. The microprocessor unit 312 receives a user selection signals 340 manually to adjust the output image color of the PDP module 300. The image processor 314 receives image display signals 350, such as the NTSC image display signals or the EBU image display signals. The power 360 provides the power for the PDP module 300.

The image processor 314 of the PDP module 300 receives the image display signal 350 and the gray level white balance device 316 transforms the same into a suitable image output signal with the gray level white balance technology. The suitable image output signal is further processed by the de-contouring processing device 319 and sent to the data driver IC 326. With the control of the scan sustainer 322, the scan driver IC 324, and the bulk sustainer 328 coupling with the timing controller 318, the color plasma display panel 330 then demonstrates the suitable image output signal with an optimum gray level white balance thereon. The timing controller 318 provides timing signals for the PDP module 300 timing control.

The PDP module with a gray level white balance device according to the present invention further uses the de-contouring processing device 319 to process the image with an error diffusion method to enhance image resolution so that the output image is more detailed and color is more uniform. Because the PDP module according to the present invention directly adjusts the gray level white balance therein, the PDP module can enhance the gray level resolution by amplifying the look up table and further enhance the contour continuity of the output image, and therefore the resolution and precision of the output image are effectively enhanced.

The PDP module according to the present invention stores the look up table in a memory of the digital image processing circuit, and therefore the PDP module can display an accurate color by referring to the look up table. The PDP module can show correct image colors according to the difference between the original color temperature and the target color temperature, the luminous efficiency decay of phosphorus, the RGB luminance, or any other influence factors. Because the look up table is directly measured on the PDP module output, the color deviation problem caused by known and unknown factors, such as luminance, luminous efficiency decay and so on, can be directly resolved by the gray level white balance according to the present invention.

The look up table is stored in the digital image processing circuit so that the PDP module can accurately output image with the look up table practical measuring the PDP module. Even if the phosphorus materials of the PDP module are changed, the PDP can work with a new look up table practical measuring on the PDP module with the new phosphorus materials. The present invention can be used not only in a PDP module but also in any display device with a gray level white balance requirement.

As is understood by a person skilled in the art, the foregoing preferred embodiments of the present invention are illustrative of the present invention rather than limiting of the present invention. It is intended that various modifications and similar arrangements be included within the spirit and scope of the appended claims, the scope of which should be accorded the broadest interpretation so as to encompass all such modifications and similar structures.

What is claimed is:

1. A plasma display panel with a gray level white balance device comprising:

a digital board comprising a gray level white balance device, the digital board receiving image display signals and processing the image display signals, the gray level white balance device modifying gray levels of the image display signals and outputting modified image display signals;

a display control circuit connecting with the digital board to receive the modified image display signals from the digital board and generate control signals; and a color plasma display panel receiving the control signals and the modified image display signals, and displaying the modified image display signals on the color plasma display panel according to the control signals.

2. The plasma display panel with a gray level white balance device of claim 1, wherein the digital board comprises:

a microprocessor unit receiving a user selection signal and issuing a request to change the gray levels of the image display signals according to the user selection signal; and an image processor coupling with the microprocessor unit to receive the request and the image display signals and transfer the request and the image display signals to the gray level white balance device.

3. The plasma display panel with a gray level white balance device of claim 2, wherein the digital board further comprises a de-contouring processing device coupling between the gray level white balance device and the display control circuit to process the modified image display signals with an error diffusion method to enhance a resolution of the modified image display signals.

4. The plasma display panel with a gray level white balance device of claim 1, wherein the gray level white balance device further comprises a look up table.

5. The plasma display panel with a gray level white balance device of claim 4, wherein the look up table is measured directly on the plasma display panel with color temperatures and color deviations to obtain the look up table with RGB gray level comparison.

6. The plasma display panel with a gray level white balance device of claim 5, wherein the look up table further utilizes a curve fitting technology to enhance resolution of the look up table.

7. The plasma display panel with a gray level white balance device of claim 5, wherein the look up table further utilizes a linear regression technology to enhance resolution of the look up table.

8. The plasma display panel with a gray level white balance device of claim 1, wherein the display control circuit further comprises:

a scan sustainer coupling between the digital board and the color plasma display panel;

a scan driver integrated circuit coupling between the scan sustainer and the color plasma display panel;

a bulk sustainer coupling between the digital board and the color plasma display panel, wherein the scan sustainer, the scan driver integrated circuit, and the bulk sustainer generate the control signals to control the color plasma display panel; and a data driver integrated circuit coupling between the digital board and the color plasma display panel to receive the modified image display signals and transmit the modified image display signals to the color plasma display panel.

9. The plasma display panel with a gray level white balance device of claim 1, wherein the digital board further comprises a timing controller to provide timing signals for the digital board and the display control circuit.

10. A gray level white balance method, comprising:

measuring fundamental color gray levels of a plasma display panel;

obtaining a gray level white balance look up table;

providing image display signals;

modifying the image display signals according to the gray level white balance look up table; and displaying the modified image display signals on the plasma display panel.

11. The gray level white balance method of claim 10, wherein after the step of displaying the modified image display signals on the plasma display panel further comprises a step of enhancing the modified image display signals with an error diffusion method.

12. The gray level white balance method of claim 10, wherein the step of measuring fundamental color gray levels of a plasma display panel further comprises:

determining a base color of fundamental colors;

adjusting a gray level of the base color of the fundamental colors;

adjusting gray levels of other colors of the fundamental colors;

measuring a color temperature and a color deviation on the plasma display panel;

determining whether the color temperature and the color deviation fit respective object values, returning to the step of adjusting gray levels of other colors of the fundamental colors when the color temperature and the color deviation do not fit the respective object value, and recording the gray level of the base color and the gray levels of other colors when the color temperature and the color deviation fit the respective object value; and returning to the step of adjusting a gray level of the base color of the fundamental colors until the gray level white balance look up table is obtained.

13. The gray level white balance method of claim 10, wherein the gray level white balance look up table further utilizes a curve fitting technology to enhance resolution of the gray level white balance look up table.

14. The gray level white balance method of claim 10, wherein the gray level white balance look up table further utilizes a linear regression technology to enhance resolution of the gray level white balance look up table.

15. A plasma display panel with a gray level white balance device comprising:

a color plasma display panel;

a digital board, the digital board comprising:

an image processor receiving image display signals;

a gray level white balance device receiving the image display signals from the image processor, the gray level white balance device modifying the image display signals to modified image display signals according to a gray level white balance look up table; and a display control circuit, the display control circuit comprising:

a scan sustainer coupling between the digital board and the color plasma display panel;

a scan driver integrated circuit coupling between the scan sustainer and the color plasma display panel;

a bulk sustainer coupling between the digital board and the color plasma display panel, wherein the scan sustainer, the scan driver integrated circuit, and the bulk sustainer generate control signals to control the color plasma display panel; and a data driver integrated circuit coupling between the digital board and the color plasma display panel to receive the modified image display signals and transmit to the color plasma display panel to display the modified image display signals.

16. The plasma display panel with a gray level white balance device of claim 15, wherein the digital board further comprises a microprocessor unit receiving a user selection signal to change the gray levels of the image display signals according to the user selection signal.

17. The plasma display panel with a gray level white balance device of claim 16, wherein the digital board further comprises a de-contouring processing device coupling between the gray level white balance device and the display control circuit to process the modified image display signals with an error diffusion method to enhance a resolution of the modified image display signals.

18. The plasma display panel with a gray level white balance device of claim 15, wherein the look up table is measured directly on the plasma display panel with color temperatures and color deviations to obtain the look up table with RGB gray level comparison.

19. The plasma display panel with a gray level white balance device of claim 15, wherein the look up table further utilizes a curve fitting technology to enhance resolution of the look up table.

20. The plasma display panel with a gray level white balance device of claim 15, wherein the look up table further utilizes a linear regression technology to enhance resolution of the look up table.

* * * * *